US011118276B2

(12) United States Patent
Imori et al.

(10) Patent No.: US 11,118,276 B2
(45) Date of Patent: Sep. 14, 2021

(54) HIGH PURITY TIN AND METHOD FOR PRODUCING SAME

(71) Applicant: JX Nippon Mining & Metals Corporation, Tokyo (JP)

(72) Inventors: Toru Imori, Ibaraki (JP); Koichi Takemoto, Ibaraki (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 159 days.

(21) Appl. No.: 15/775,731

(22) PCT Filed: Mar. 2, 2017

(86) PCT No.: PCT/JP2017/008342
§ 371 (c)(1),
(2) Date: Sep. 28, 2018

(87) PCT Pub. No.: WO2017/154740
PCT Pub. Date: Sep. 14, 2017

(65) Prior Publication Data

US 2019/0153607 A1 May 23, 2019

(30) Foreign Application Priority Data

Mar. 9, 2016 (JP) ..... JP2016-046060

(51) Int. Cl.
*C25C 1/14* (2006.01)
*C25C 7/04* (2006.01)
(Continued)

(52) U.S. Cl.
CPC ..... *C25C 1/14* (2013.01); *C22B 25/08* (2013.01); *C22C 13/00* (2013.01); *C25C 7/04* (2013.01);
(Continued)

(58) Field of Classification Search
CPC ..... C22C 13/00; C22C 13/02; C22C 2202/00; C25C 1/14; C25C 7/04; C25C 7/06; C22B 25/04; C25D 3/30
See application file for complete search history.

(56) References Cited

U.S. PATENT DOCUMENTS

2003/0019759 A1 1/2003 Shindo et al.
2005/0000821 A1* 1/2005 White et al. ..... H01L 24/05 205/157
(Continued)

FOREIGN PATENT DOCUMENTS

CN 1582346 A 2/2005
EP 2260968 A1 12/2010
(Continued)

OTHER PUBLICATIONS

American Elements, "Tin Nanoparticles" (Year: 2015).*
(Continued)

*Primary Examiner* — Anthony J Zimmer
*Assistant Examiner* — Dean Mazzola
(74) *Attorney, Agent, or Firm* — Faegre Drinker Biddle & Reath LLP

(57) ABSTRACT

Provided is high purity tin having purity of 5N (99.999% by mass), which can suppress generation of particles. According to the high purity tin, the number of particles each having a particle diameter of 0.5 μm or more is 50,000 or less per a gram.

9 Claims, 4 Drawing Sheets

(51) Int. Cl.

| | |
|---|---|
| ***C25C 7/06*** | (2006.01) |
| ***C22C 13/00*** | (2006.01) |
| ***C22B 25/08*** | (2006.01) |
| ***C25D 3/30*** | (2006.01) |

(52) U.S. Cl.
CPC ..... *C25C 7/06* (2013.01); *C25D 3/30* (2013.01); *C22C 2202/00* (2013.01)

(56) References Cited

U.S. PATENT DOCUMENTS

| | | | |
|---|---|---|---|
| 2007/0166828 | A1 | 7/2007 | Strothers et al. |
| 2009/0098012 | A1 | 4/2009 | Shindo et al. |
| 2011/0089567 | A1 | 4/2011 | Ishikawa et al. |
| 2013/0028786 | A1 | 1/2013 | Kanou |
| 2013/0341196 | A1 | 12/2013 | Silinger et al. |
| 2014/0332404 | A1 | 11/2014 | Shindo et al. |

FOREIGN PATENT DOCUMENTS

| | | | |
|---|---|---|---|
| JP | 62001478 | B2 | 1/1987 |
| JP | 2754030 | B2 | 5/1998 |
| JP | 11343590 | A | 12/1999 |
| JP | 2002047592 | A | 2/2002 |
| JP | 3882608 | B2 | 2/2007 |
| JP | 5296269 | B1 | 9/2013 |
| JP | 2014025121 | A | 2/2014 |
| WO | 03044246 | A1 | 5/2003 |
| WO | 2007004394 | A | 1/2007 |
| WO | 2010089905 | A1 | 8/2010 |
| WO | 2011114824 | A1 | 9/2011 |

OTHER PUBLICATIONS

Extended European Search Report for EP Application No. 17763080.3 corresponding to PCT/JP2017/008342 dated Oct. 22, 2019, 8 pages.
International Search Report for PCT/JP2017/008342 dated Apr. 4, 2017, 4 pages.
"Soluble anode electrolysis to produce high-purity tin, Go to the smelter", Nonferrous Metals (Extractive Metallurgy), 4th period, pp. 38-39, Mar. 1, 1972 (including translation).
Chinese Office Action in corresponding CN 2019/10893030.2, dated Feb. 24, 2021, 8 pages (including translation).

* cited by examiner

[FIG. 1]
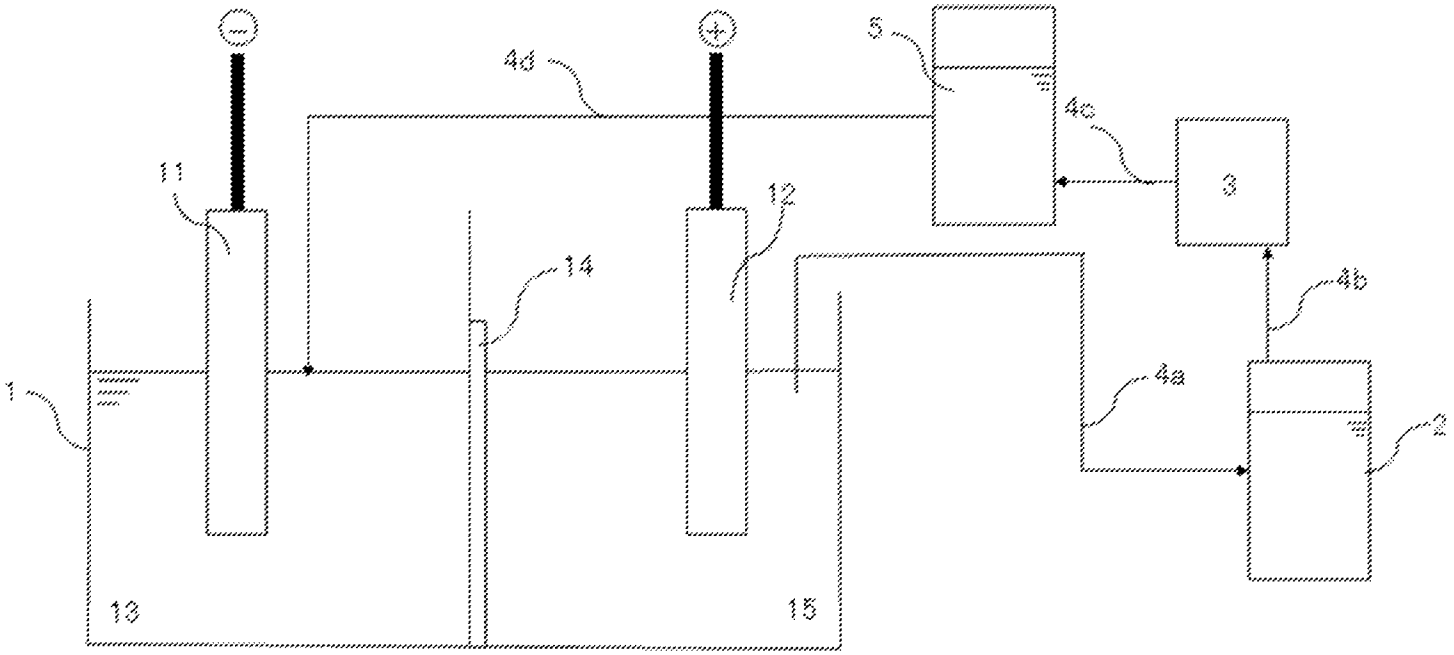

[FIG. 2]
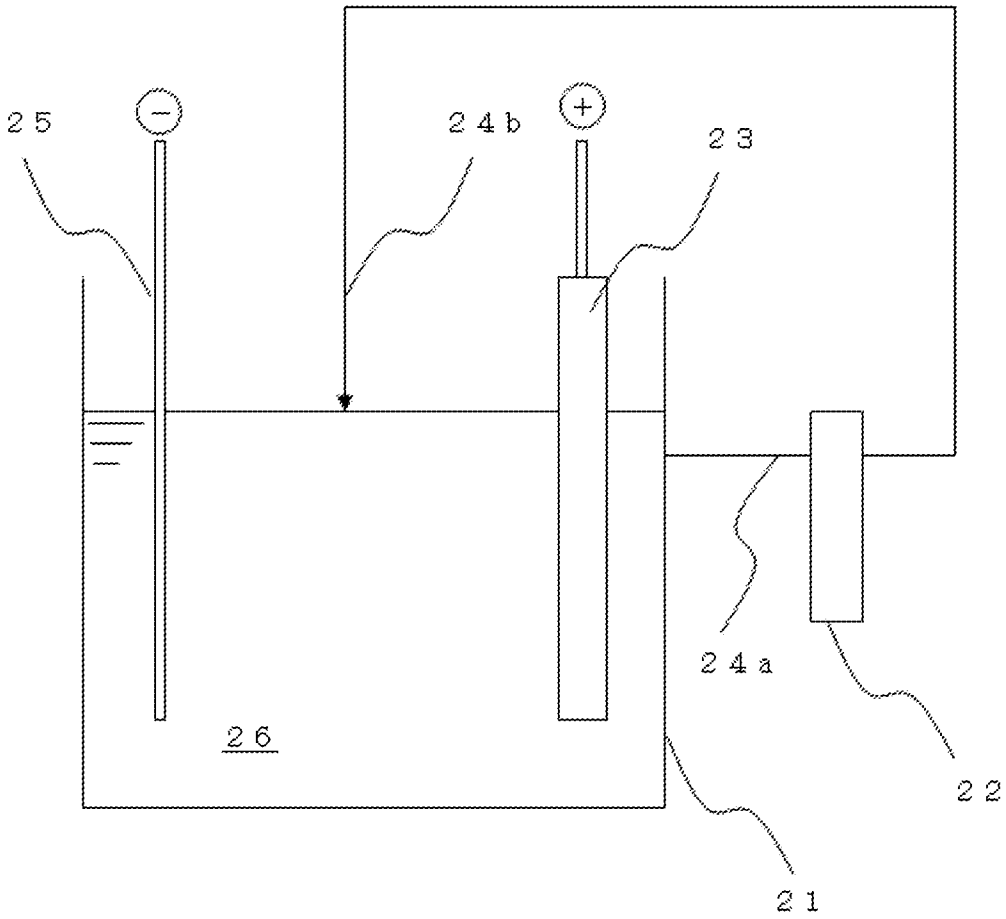

[FIG. 3-1]

| Lot No | Raw Material | Example 1 | Example 2 | Example 3 | Comparative 1 | Comparative 2 |
|---|---|---|---|---|---|---|
| Unit | ppm | ppm | ppm | ppm | ppm | ppm |
| Matrix | Sn | Sn | Sn | Sn | Sn | Sn |
| Element | Concentration | Concentration | Concentration | Concentration | Concentration | Concentration |
| Li | < 0.005 | <0.005 | <0.005 | <0.005 | <0.005 | <0.005 |
| Be | < 0.005 | <0.005 | <0.005 | <0.005 | <0.005 | <0.005 |
| B | < 0.005 | <0.005 | <0.005 | <0.005 | <0.005 | <0.005 |
| F | < 0.05 | <0.05 | <0.05 | <0.05 | <0.05 | <0.05 |
| Na | < 0.01 | <0.01 | <0.01 | <0.01 | <0.01 | <0.01 |
| Mg | < 0.01 | <0.01 | <0.01 | <0.01 | <0.01 | <0.01 |
| Al | < 0.01 | <0.01 | <0.01 | <0.01 | <0.01 | <0.01 |
| Si | < 0.01 | <0.01 | <0.01 | <0.01 | <0.01 | <0.01 |
| P | < 0.01 | <0.01 | <0.01 | <0.01 | <0.01 | 0.01 |
| S | 4 | <0.01 | <0.01 | <0.01 | <0.01 | <0.01 |
| Cl | < 0.01 | <0.01 | <0.01 | <0.01 | <0.01 | 0.8 |
| K | < 0.01 | <0.01 | <0.01 | <0.01 | <0.01 | <0.01 |
| Ca | < 0.01 | <0.01 | <0.01 | <0.01 | <0.01 | <0.01 |
| Sc | < 0.001 | <0.001 | <0.001 | <0.001 | <0.001 | <0.001 |
| Ti | < 0.005 | <0.005 | <0.005 | <0.005 | <0.005 | <0.005 |
| V | < 0.001 | <0.001 | <0.001 | <0.001 | <0.001 | <0.001 |
| Cr | < 0.005 | <0.005 | <0.005 | <0.005 | <0.005 | <0.005 |
| Mn | < 0.005 | <0.005 | <0.005 | <0.005 | <0.005 | <0.005 |
| Fe | 1.51 | <0.005 | <0.005 | <0.005 | 0.049 | <0.005 |
| Co | < 0.01 | <0.01 | <0.01 | <0.01 | <0.01 | <0.01 |
| Ni | < 0.01 | <0.01 | <0.01 | <0.01 | <0.01 | <0.01 |
| Cu | 0.03 | <0.005 | <0.005 | <0.005 | 0.014 | <0.005 |
| Zn | < 0.01 | <0.01 | <0.01 | <0.01 | <0.01 | <0.01 |
| Ga | < 0.005 | <0.005 | <0.005 | <0.005 | <0.005 | <0.005 |
| Ge | < 0.01 | <0.01 | <0.01 | <0.01 | <0.01 | <0.01 |
| As | 0.01 | <0.005 | <0.005 | <0.005 | <0.005 | <0.005 |
| Se | < 0.01 | <0.01 | <0.01 | <0.01 | <0.01 | <0.01 |
| Br | < 0.05 | <0.05 | <0.05 | <0.05 | <0.05 | <0.05 |
| Rb | < 0.005 | <0.005 | <0.005 | <0.005 | <0.005 | <0.005 |
| Sr | < 0.005 | <0.005 | <0.005 | <0.005 | <0.005 | <0.005 |
| Y | < 0.005 | <0.005 | <0.005 | <0.005 | <0.005 | <0.005 |
| Zr | < 0.005 | <0.005 | <0.005 | <0.005 | <0.005 | <0.005 |
| Nb | < 0.005 | <0.005 | <0.005 | <0.005 | <0.005 | <0.005 |
| Mo | < 0.01 | <0.01 | <0.01 | <0.01 | <0.01 | <0.01 |
| Ru | < 0.01 | <0.01 | <0.01 | <0.01 | <0.01 | <0.01 |
| Rh | < 0.005 | <0.005 | <0.005 | <0.005 | <0.005 | <0.005 |
| Pd | < 0.005 | <0.005 | <0.005 | <0.005 | <0.005 | <0.005 |

[FIG. 3-2]

| Lot No | Raw Material | Example 1 | Example 2 | Example 3 | Comparative 1 | Comparative 2 |
|---|---|---|---|---|---|---|
| Unit | ppm | ppm | ppm | ppm | ppm | ppm |
| Matrix | Sn | Sn | Sn | Sn | Sn | Sn |
| Element | Concentration | Concentration | Concentration | Concentration | Concentration | Concentration |
| Ag | 0.13 | <0.005 | <0.005 | <0.005 | 0.019 | <0.005 |
| Cd | < 0.05 | <0.05 | <0.05 | <0.05 | <0.05 | <0.05 |
| In | < 1 | <1 | <1 | <1 | <1 | <1 |
| Sn | Matrix | Matrix | Matrix | Matrix | Matrix | Matrix |
| Sb | 0.93 | <0.5 | <0.5 | <0.5 | <0.5 | <0.5 |
| Te | < 0.1 | <0.1 | <0.1 | <0.1 | <0.1 | <0.1 |
| I | < 0.05 | <0.05 | <0.05 | <0.05 | <0.05 | <0.05 |
| Cs | < 0.05 | <0.05 | <0.05 | <0.05 | <0.05 | <0.05 |
| Ba | < 0.1 | <0.1 | <0.1 | <0.1 | <0.1 | <0.1 |
| La | < 0.1 | <0.1 | <0.1 | <0.1 | <0.1 | <0.1 |
| Ce | < 0.005 | <0.005 | <0.005 | <0.005 | <0.005 | <0.005 |
| Pr | < 0.1 | <0.1 | <0.1 | <0.1 | <0.1 | <0.1 |
| Nd | < 0.005 | <0.005 | <0.005 | <0.005 | <0.005 | <0.005 |
| Sm | < 0.005 | <0.005 | <0.005 | <0.005 | <0.005 | <0.005 |
| Eu | < 0.01 | <0.01 | <0.01 | <0.01 | <0.01 | <0.01 |
| Gd | < 0.005 | <0.005 | <0.005 | <0.005 | <0.005 | <0.005 |
| Tb | < 0.005 | <0.005 | <0.005 | <0.005 | <0.005 | <0.005 |
| Dy | < 0.005 | <0.005 | <0.005 | <0.005 | <0.005 | <0.005 |
| Ho | < 0.005 | <0.005 | <0.005 | <0.005 | <0.005 | <0.005 |
| Er | < 0.005 | <0.005 | <0.005 | <0.005 | <0.005 | <0.005 |
| Tm | < 0.005 | <0.005 | <0.005 | <0.005 | <0.005 | <0.005 |
| Yb | < 0.005 | <0.005 | <0.005 | <0.005 | <0.005 | <0.005 |
| Lu | < 0.005 | <0.005 | <0.005 | <0.005 | <0.005 | <0.005 |
| Hf | < 0.01 | <0.01 | <0.01 | <0.01 | <0.01 | <0.01 |
| Ta | < 5 | <5 | <5 | <5 | <5 | <5 |
| W | < 0.01 | <0.01 | <0.01 | <0.01 | <0.01 | <0.01 |
| Re | < 0.01 | <0.01 | <0.01 | <0.01 | <0.01 | <0.01 |
| Os | < 0.01 | <0.01 | <0.01 | <0.01 | <0.01 | <0.01 |
| Ir | < 0.01 | <0.01 | <0.01 | <0.01 | <0.01 | <0.01 |
| Pt | < 0.01 | <0.01 | <0.01 | <0.01 | <0.01 | <0.01 |
| Au | < 0.05 | <0.05 | <0.05 | <0.05 | <0.05 | <0.05 |
| Hg | < 0.05 | <0.05 | <0.05 | <0.05 | <0.05 | <0.05 |
| Tl | < 0.02 | <0.02 | <0.02 | <0.02 | <0.02 | <0.02 |
| Pb | 7.8 | <0.01 | <0.01 | <0.01 | <0.01 | <0.01 |
| Bi | < 0.005 | <0.005 | <0.005 | <0.005 | <0.005 | <0.005 |
| Th | < 0.005 | <0.005 | <0.005 | <0.005 | <0.005 | <0.005 |
| U | < 0.005 | <0.005 | <0.005 | <0.005 | <0.005 | <0.005 |
| O | 230 | <5 | <5 | <5 | 40 | 120 |
| LPC(cnts/g) | >100,000 | 5,170 | 9,060 | 13,800 | 71,800 | 75,800 |

HIGH PURITY TIN AND METHOD FOR PRODUCING SAME

TECHNICAL FIELD

The present invention relates to high purity tin (Sn) with decreased particles and a method for producing the same.

BACKGROUND ART

A commercially available high purity tin is generally produced by an electrolytic method using an acidic electrolytic bath such as tin sulfamate, tin sulfate and tin chloride.

For example, Japanese Patent Application Public Disclosure (KOKOKU) No. S62-1478 B (Patent Document 1) describes a method for carrying out electrolysis in an electrolytic bath comprising 99.95% by weight or more of tin as an anode and having a liquid composition comprising 30 to 150 g/L of Sn and 30 to 200 g/L of sulfamic acid that contains few radioisotope elements under electrolytic conditions of cathode current density of 0.5 to 2.0 Amp/dm$^2$ and a liquid temperature of 15 to 50° C., for the purpose of lowering a rays (claim 2 of Patent Document 1).

Japanese Patent No. 2754030 (Patent Document 2) describes a method for producing tin by carrying out electrolysis in an electrolytic solution containing 90 to 240 g/L of sulfuric acid that at least conforms to the standard of the first class grade sulfuric acid defined in JIS K 8951 and 10 to 50 g/L of hydrochloric acid that at least conforms to the standard of the first class grade hydrochloric acid defined in JIS K 8180 using tin having a purity of 99.97% by weight or more as an anode, for the purpose of lowering a rays (claim 1 of Patent Document 2).

Japanese Patent No. 3882608 (Patent Document 3) describes a method for removing lead by electrolytic refining of impurities in metallic tin. More particularly, it describes a method of electrolytic refining of high purity tin using an electrolytic solution comprised of a mixed acid of sulfuric acid and silicofluoric acid, which comprises withdrawing the tin electrolytic solution from an electrolytic bath and guiding it to a precipitation tank; adding strontium carbonate to the electrolytic solution in the precipitation tank to precipitate lead in the solution at a liquid temperature of 35° C. or lower; then guiding the electrolytic solution containing said precipitates to a filter unit to separate the precipitates by filtration; and recycling the precipitates-removed electrolytic solution to the electrolytic bath and carrying out electrolytic refining of tin (claim 1 of Patent Document 3).

Japanese Patent No. 5296269 (Patent Document 4) discloses a method for conducting electrolytic refining by leaching tin as a raw material with an acid such as sulfuric acid to form a leached solution as an electrolytic solution, suspending an adsorbent for impurities in the electrolytic solution, conducting the electrolytic refining using a raw material Sn anode, thereby providing high purity tin having a purity of 5 N or more (excluding gas components of O, C, N, H, S and P). More particularly, it describes a method for conducing electrolytic refining in a sulfuric acid bath or a hydrochloric acid bath containing tin having 3N level as the anode at an electrolysis temperature of 10 to 80° C. and under a condition of a current density of 0.1 to 50 A/dm$^2$. It also discloses that impurities are adsorbed by suspending an oxide such as titanium oxide, aluminum oxide and tin oxide, activated carbon, and carbon in the electrolytic solution.

PRIOR ART DOCUMENT

[Patent Document 1] Japanese Patent Application Public Disclosure (KOKOKU) No. S62-1478 B2
[Patent Document 2] Japanese Patent No. 2754030 B2
[Patent Document 3] Japanese Patent No. 3882608 B2
[Patent Document 4] Japanese Patent No. 5296269 B1

SUMMARY OF THE INVENTION

Problem to be Solved by the Invention

According to the production methods disclosed in the prior arts, it is possible to obtain high purity tin. However, it has been found that the high purity tin as described in the prior arts does not exhibit sufficient properties as a solder material for micro-fine wiring, and when such high purity metal is used as a molten metal in a ultrafine processing apparatus such as LSI, clogging of fine flow channels occurs due to particles present in the molten metal, thereby hindering the ultrafine processing step.

The present invention has been made in view of the above circumstances, and one of objects of the present invention is to provide high purity tin with suppressed generation of particles. Another object of the present invention is to provide a method for producing high purity tin with suppressed generation of particles.

Means for Solving the Problem

The present inventors have investigated causes of the above problems, and found that contaminants from the outside of the system, such as a tin oxide (SnO, $SnO_2$) or a tin sulfide (SnS, $SnS_2$) resulting from combining with gas component elements such as oxygen (O) and sulfur (S), and further silicon dioxide ($SiO_2$), are causative substances for the particles. The present inventors have completed the present invention based on the finding.

Based on results of the investigations, the present inventors have found that it is effective to conduct the following operations in order to effectively suppress the particles:

employing two-stage refining when highly purifying tin: in a first stage, tin is subjected to electrolytic refining in a sulfuric acid bath, and in a second stage, tin is further subjected to electrolytic refining in a hydrochloric acid bath;

in the first stage electrolytic refining in the sulfuric acid bath, withdrawing an electrolytic solution present on an anode side in the electrolytic bath partitioned by a diaphragm between the anode and the cathode, and removing lead or an oxide sludge in the withdrawn electrolytic solution and then circulating the electrolytic solution to the cathode side of the electrolytic bath, as well as adding a smoothing agent to the electrolytic solution to form electrodeposited tin in the form of plate, thereby reducing a surface area of the electrodeposited tin;

removing primary refined tin obtained by the first stage electrolytic refining in the sulfuric acid bath from the electrolytic bath, and melt and cast it to form an anode plate; at this time, carbon that is the component of the smoothing agent is removed by evaporation; and then in order to conduct the second stage electrolytic refining, carrying out electrolytic refining in a hydrochloric acid bath using a different electrolytic bath from that in the first stage without employing the smoothing agent in order to prevent the smoothing agent components from being involved in the electrodeposited tin, withdrawing the electrolytic solution in the electrolytic bath, removing particles in the withdrawn electrolytic solution and then circulating the electrolytic solution again to the electrolytic bath; and further melting and casting secondary refined tin obtained by the second stage electrolytic refining in the hydrochloric acid bath in a reducing gas atmosphere, thereby reducing the oxides that will cause the particles contained in refined tin and removing oxygen.

The present invention has been accomplished based on the above findings. In one aspect, the present invention relates to high purity tin having a purity of 5N (99.999% by mass) or more, wherein the number of particles each having a particle diameter of 0.5 μm or more is 50,000 or less per a gram.

In one embodiment of the high purity tin according to the present invention, the number of particles each having a particle diameter of 0.5 μm or more is 10,000 or less per a gram.

In another embodiment of the high purity tin according to the present invention, each of concentrations of iron, copper, lead and sulfur contained in the high purity tin is 0.5 ppm by mass or less.

In still another embodiment of the high purity tin according to the present invention, a concentration of antimony is 1 ppm by mass or less.

In still another embodiment of the high purity tin according to the present invention, a concentration of oxygen is less than 5 ppm by mass.

In another aspect, the present invention provides a method for producing high purity tin, comprising:

a step (1) of providing primary refined electrodeposited tin having improved purity on a surface of a cathode by carrying out electrolytic refining in an electrolytic bath partitioned into an anode chamber and a cathode chamber by disposing a diaphragm between an anode and a cathode, said electrolytic bath containing an sulfuric acidic solution of tin sulfate as an electrolytic solution and raw material tin as said anode, said raw material tin having a lead content of 20 ppm by mass or less, an iron content of 5 ppm by mass or less, a copper content of 0.5 ppm by mass or less, an antimony content of 5 ppm by mass or less and the total content of silver, arsenic, bismuth, cadmium, copper, iron, indium, nickel, lead, antimony and zinc of 30 ppm by mass or less, while adding to at least said cathode camber a smoothing agent for reducing a surface area of electrodeposited tin, wherein said step (1) comprises withdrawing at least a part of said tin sulfate solution on said anode chamber side, removing lead and an oxide sludge in said withdrawn tin sulfate solution, and supplying said tin sulfate solution resulting from the removal of lead and the oxide sludge to said cathode chamber;

a step (2) of providing needle-like secondary refined electrodeposited tin on a surface of said cathode by carrying out electrolytic refining in an electrolytic bath containing said primary refined electrodeposited tin or cast tin resulting from heating, melting and casting of said primary refined electrodeposited tin as an anode and a hydrochloric acidic solution of tin chloride as an electrolytic solution, wherein said step (2) comprises withdrawing at least a part of said tin chloride solution from said electrolytic bath, removing particles in said tin chloride solution and remaining components of said smoothing agent carried from the step (1), and then recycling to said electrolytic bath again said tin chloride solution from which said particles and said remaining components of said smoothing agent have been removed; and a step (3) comprising melting and casting said needle-like secondary refined electrodeposited tin in a reducing gas atmosphere.

In one embodiment of the high purity tin according to the present invention, said smoothing agent comprises a non-ionic surfactant composed of a compound having a structure in which one or more hydroxyl groups are bonded to an aryl group(s) directly or via one or more methylene groups and/or one or more ethylene oxide groups.

In another embodiment of the high purity tin according to the present invention, said smoothing agent comprises polyoxyethylene alkyl phenyl ether.

In still another embodiment of the high purity tin according to the present invention, said step (1) further comprises adding an antioxidant to said tin sulfate solution together with said smoothing agent.

Effect of the Invention

When used as a molten metal, the high purity tin according to the present invention has extremely reduced oxygen, sulfur and silicon, can suppress formation of undesirable particles, does not cause clogging of fine flow channels, and can suppress hindrance to ultrafine processing steps. According to the present invention, sulfur that is difficult to be removed by one-stage refining with the sulfuric acid bath can be decreased by the two-stage refining consisting of refining with the sulfuric acid bath and subsequent further refining with the hydrochloric acid bath, and the surface area of the electrodeposited tin can be reduced to suppress the formation of surface oxides by adding the smoothing agent to the electrolytic solution in the sulfuric acid bath in the first stage, and further nonmetallic inclusions can be extremely reduced by filtering the electrolytic solution in the hydrochloric acid bath in the second stage to remove substances causing the particles and further melting and casting the needle-like electrodeposited tin precipitated in the hydrochloric acid bath in the reducing atmosphere. More particularly, it is possible to obtain high purity metallic tin in which the number of particles each having a particle size of 0.5 μm or more is 50,000 or less per a gram.

BRIEF DESCRIPTION OF THE DRAWINGS

FIG. 1 shows a constitutional example of an electrolytic refining apparatus for carrying out a step (1) to produce primary refined electrodeposited tin.

FIG. 2 shows a configuration example of an electrolytic refining apparatus for carrying out a step (2) to produce secondary refined electrodeposited tin.

FIG. 3-1 shows results of elemental analysis for refined tin and measurement results of the number of particles in Examples and Comparative Examples.

FIG. 3-2 shows results of elemental analysis for refined tin and measurement results of the number of particles in Examples and Comparative Examples (continuation of FIG. 3-1).

MODES FOR CARRYING OUT THE INVENTION (Step (1))

Embodiments of the method for producing the high purity tin according to the present invention will be described below. In an embodiment, the method for producing the high purity tin according to the present invention comprises a step (1) of providing an electrodeposited tin with improved purity on a surface of a cathode by carrying out electrolytic refining in an electrolytic bath partitioned into an anode chamber and a cathode chamber by disposing a diaphragm between the anode and the cathode, using a sulfuric acidic solution of tin sulfate as an electrolytic solution and raw material tin as the anode.

The step (1) can be carried out using, for example, an electrolytic refining apparatus as shown in FIG. 1. As can be seen from FIG. 1, the electrolytic refining apparatus comprises an electrolytic bath 1, a liquid cleaning tank 2 for withdrawing at least a part of an electrolytic solution in the electrolytic bath 1 to clean the electrolytic solution, a filtering device 3 connected to the liquid cleaning tank 2, a storage tank 5 for storing the electrolytic solution after refining, and liquid supply lines 4*a* to 4*d* for delivering the electrolytic solution.

In the electrolytic bath 1, a cathode 11 and an anode 12 are arranged. The inside of the electrolytic bath 1 is partitioned by a diaphragm 14 into a cathode chamber 13 in which the cathode 11 is arranged and an anode chamber 15 in which the anode 12 is arranged. The diaphragm 14 is disposed between the cathode 11 and the anode 12 in order to inhibit impurity ions generated from the anode 12 from being deposited onto the cathode 11. The diaphragm 14 that can be suitably used includes an ion exchange membrane.

The raw material tin used for the anode 12 preferably has a lead content of 20 ppm or less, and preferably 10 ppm or less, and more preferably 5 ppm or less, in order to further reduce the lead content in the electrodeposited tin. The raw material tin preferably has an iron content of 5 ppm or less, and preferably 1 ppm or less, and an antimony content of 5 ppm or less, and preferably 1 ppm or less, and the total content of silver, arsenic, bismuth, cadmium, copper, iron, indium, nickel, lead, antimony and zinc of 30 ppm or less, and more preferably 10 ppm or less. For the cathode 11, a metal plate made of tin, aluminum, stainless steel, titanium or the like, or a graphite plate can be used.

The purity of the raw material tin is preferably 99.9% by mass (3N) or more, and more preferably 99.995% by mass (4N5) or more, because excessively low purity will impose a burden on the refining step. However, since the use of raw material tin having excessively high purity will deteriorates economical efficiency, typical purity of the raw material tin is 99.95 to 99.99% by mass (3N5 to 4N), and more typical purity of the raw material tin is 99.99 to 99.995% by mass (4N to 4N5).

It should be noted that the method of measuring the impurity elements contained in the raw material tin is the same as that of the high purity tin as described below.

It is preferable to add a smoothing agent for improving surface properties of the electrodeposited tin to the electrolytic solution. Examples of the smoothing agent that can be used includes preferably a nonionic surfactant composed of a compound having a structure in which one or more hydroxyl groups are bonded to an aryl group(s) directly or via one or more methylene groups and/or one or more ethylene oxide groups.

The use of the compound having one or more hydroxyl groups directly or indirectly bonded to the aryl group(s) as the smoothing agent inhibits decomposition of the smoothing agent during electrolysis as compared with a compound that does not have such a structure, so that effects of the smoothing agent can be stably obtained for a long period of time. When the smoothing agent is added, it will be difficult to obtain high purity electrodeposited tin due to a decreased potential difference between tin and lead. However, the present inventors have found that by providing the diaphragm between the anode and the cathode, lead eluted from the anode can be prevented from being deposited as it is on the cathode. Furthermore, by removing lead ions accumulated in the electrolytic solution on the anode chamber side and supplying the electrolytic solution obtained by removing the lead ions to the cathode chamber, the problem of the potential difference between tin and lead can be solved, as well as casting yield in the subsequent melting and casting step can be improved, and electrodeposited tin having high purity and good surface properties can be obtained.

Examples of the smoothing agent that can be suitable used include compounds represented by the following chemical formulae (1) to (4):

[Chem. 1]

(1)

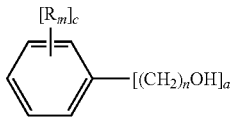

[Chem. 2]

(2)

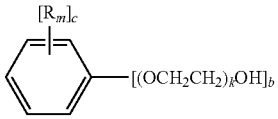

[Chem. 3]

(3)

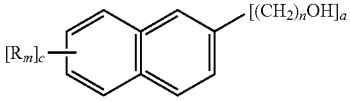

[Chem. 4]

(4)

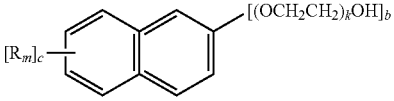

in which formulae (1) to (4), m and n each represents an integer of 0 to 12; a, b and c each represents an integer of 1 to 3; k represents an integer of 4 to 24; R represents hydrogen, or an organic group (typically having 1 to 3 carbon atoms) such as a substituted or unsubstituted alkyl group, a substituted or unsubstituted aryl group, and a substituted or unsubstituted aralkyl group.

More preferably, examples of the smoothing agent that can be used include one or more selected from the group consisting of α-naphthol, β-naphthol, EO (ethylene oxide) adducts of α-naphthol, EO adducts of β-naphthol and polyoxyethylene alkyl phenyl ether. Amog them, β-naphthol and polyoxyethylene nonyl phenyl ether may be preferably used. On the other hand, a chain compound having a hydroxyl group but not having an aryl group may not be suitable for the embodiment of the present invention in terms of lifetime and stability because it decomposes during electrolysis.

The content of the smoothing agent in the electrolytic solution is preferably 1 to 20 g/L at least in the cathode chamber, and more preferably 3 to 10 g/L. If the content of the smoothing agent is extremely low, it will be difficult to obtain the effect of improving the surface properties of the electrodeposited tin. In contrast, if the content of the smoothing agent is excessive, economic waste will occur, as well as involvement of organic substances in the electrodeposited tin will increase, leading to an increase in oxygen. The smoothing agent can be added, for example, in the storage tank 5 for circulating and supplying the electrolytic solution into the cathode chamber 13. In addition to the smoothing agent, an antioxidant such as hydroquinone may be added in an amount of about 1 to 10 g/L, and more preferably 4 to 6 g/L, to the electrolytic solution. The addition of the antioxidant can prevent oxidation of tin ions dissolved in the electrolytic solution from +2 valence to +4 valence, suppress deposition and precipitation in the electrolytic solution, and prevent reduction of electrolytic refining efficiency.

Referring to FIG. 1, the liquid supply lines 4*a* to 4*d* are liquid supply lines for withdrawing the electrolytic solution in the electrolytic bath 1, cleaning and purifying the electrolytic solution, and returning the purified electrolytic solution to the electrolytic bath 1 again. The electrolytic solution withdrawn from the electrolytic bath 1 is supplied to the liquid cleaning tank 2 through the liquid supply line 4*a*. In the liquid cleaning tank 2, lead in the withdrawn electrolytic solution is removed. The use of the anode 12 having a lead content of 20 ppm or less in the raw material tin results in decreased elution of lead, but still lead is accumulated in the electrolytic solution due to electrolytic refining for a long time. Therefore, it is desirable to remove lead from the electrolytic solution. The removal of lead can be carried out by solvent extraction of the lead ions using an extracting agent, an adsorption treatment with an ion exchange resin or like, salt precipitation of insoluble sulfide salts by addition of a sulfide, coprecipitation by addition of a coprecipitating agent made of a salt of an alkaline earth metal such as strontium and barium, or the like. For example, when coprecipitation is carried out by using strontium, the liquid cleaning tank 2 is equipped with an stirring means (not shown), and a coprecipitating agent such as strontium carbonate is added with stirring to produce a lead-containing precipitate of strontium sulfate ($SrSO_4$) in the electrolytic solution. As the coprecipitating agent, alkaline earth metal salts such as barium carbonate may also be used. The stirring time may be appropriately adjusted in view of the lead content, and it may be, for example, 1 to 24 hours. The amount of the coprecipitating agent added may be preferably 1 to 30 g/L, and more preferably 3 to 20 g/L, and still more preferably 3 to 10 g/L.

The electrolytic solution withdrawn from the liquid cleaning tank 2 is fed to a filtering device 3 such as a filter press via the liquid supply line 4*b*, and subjected to solid-liquid separation. This allows removal of solid impurities such as oxide sludge containing tin oxide and noble metals (such as copper and lead) in the electrolytic solution. Further, when the precipitate is generated in the electrolytic solution by using the coprecipitating agent such as strontium carbonate in the liquid cleaning tank 2, lead contained in the electrolytic solution is caught into strontium sulfate and removed. The solid-liquid separation allows the lead concentration in the electrolytic solution to be reduced to typically 0.2 mg/L or less, and more typically to 0.1 mg/L or less. The filtrate obtained by the solid-liquid separation is fed as a purified electrolytic solution to the storage tank 5 via the liquid supply line 4*c* and to the cathode chamber 13 in the electrolytic bath 1 via the liquid supply line 4*d* so as to be circulated. In the storage tank 5, the smoothing agent, and optionally sulfuric acid and the antioxidant or like can be further added to the electrolytic solution to adjust the composition of the electrolytic solution.

Thus, lead is removed by the liquid cleaning tank 2 and the solid impurities such as oxides are removed by the filtering device 3 from the electrolytic solution to be supplied to the cathode chamber 13, so that the electrolytic solution can allow the involvement of the lead ions and oxides to be reduced during deposition of the electrodeposited tin.

The liquid supply line 4*a* is connected to the anode chamber 15 in the electrolytic bath 1, and preferably withdraws the electrolytic solution (anolyte) containing lead dissolved out from the raw material tin making up the anode 12 in the anode chamber 15. Thus, the electrolytic solution (anolyte) in the anode chamber 15 is withdrawn, lead and the oxide sludge in the electrolytic solution are removed in the liquid cleaning tank 2, and the electrolytic solution from which lead and the oxide sludge have been removed is circulated to the side of the cathode chamber 13 to reuse it as an electrolytic solution (catholyte) in the cathode chamber 13, so that the replenishing frequency of fresh electrolytic solutions can be reduced, thereby allowing effective utilization of the electrolytic solution and improvement of the production efficiency of high purity tin.

Furthermore, the smoothing agent is added to the electrolytic solution supplied into the cathode chamber 13, thereby allowing the surface profile of the electrodeposited tin precipitated on the surface of the cathode 11, which was in the form of needle in the prior art, to be flattened, so that plate-like electrodeposited tin can be obtained. Consequently, as compared with the case of using the conventional needle-like electrodeposited tin, the involvement of the electrolytic solution in the electrodeposited tin during pulling up the electrodeposited tin can be reduced, thereby reducing the replenishing frequency of the electrolytic solutions, as well as the casting yield in the production of metallic tin by subsequent melting and casting can also be improved and contamination of a sulfur component, a main component of the electrolytic solution, into the electrodeposited tin can also be prevented, thereby improving the productivity of the high purity tin.

If the concentration of tin in the electrolytic solution is too high, the tin ions will precipitate due to an excess of saturation solubility. On the other hand, if it is too low, an increased amount of hydrogen is generated from the cathode plate, preventing the deposition of tin. Therefore, the tin concentration is preferably about 1 to 100 g/L, and more preferably 30 to 100 g/L.

If the pH of the electrolytic solution is too high, the tin ions will precipitates as hydroxides by hydrolysis, thereby reducing the tin concentration. On the other hand, if it is too low, an increased amount of hydrogen is generated from the cathode plate, preventing the deposition of tin. Therefore, the pH is preferably from 0 to 1.0, and more preferably from 0.3 to 0.8.

If the liquid temperature of the electrolytic solution is too high, mechanical load on the facility will increase. On the other hand, if it is too low, energy will be wastefully consumed. Therefore, the liquid temperature may be preferably 10 to 40° C.

The current density of the cathode during electrolytic refining may be preferably 1 to 5 $A/dm^2$, and more preferably 2 to 3 $A/dm^2$. If the current density is too low, the productivity will be decreased. If the current density is too high, the electrolytic voltage will be increased, so that the effect of the smoothing agent may be decreased and tin may precipitate in the form of needle.

It is preferable that after the electrolytic refining with the sulfuric acid bath, the plate-like primary refined electrodeposited tin deposited on the surface of the cathode is pulled up and recovered from the electrolytic bath, the recovered plate-like primary refined electrodeposited tin is sufficiently washed with pure water and then dried. While an excessive low drying temperature consumes time, an excessive high drying temperature may lead to excessive oxidation of tin due to heat. Therefore, the drying may be carried out at 60 to 100° C., and more preferably at 80 to 100° C.

(Step (2))

In an embodiment, the method for producing the high purity tin according to the present invention comprises a step (2) of providing needle-like secondary refined electrodeposited tin on the surface of the cathode by conducing electrolytic refining in an electrolytic bath using the primary refined electrodeposited tin obtained in the step (1) or cast tin resulting from heating, melting and casting of the primary refined electrodeposited tin as an anode and a hydrochloric acidic solution of tin chloride as an electrolytic solution.

The step (2) can be carried out using an electrolytic refining apparatus as shown in FIG. 2, for example. As can be seen from FIG. 2, the electrolytic refining apparatus comprises an electrolytic bath 21, a filter 22 for withdrawing at least a part of an electrolytic solution in the electrolytic bath 21 to filter the electrolytic solution, and liquid supply lines 24*a* to 24*b* for delivering the electrolytic solution.

In the electrolytic bath 21, a cathode 25 and an anode 23 are arranged. An electrolytic solution 26 is disposed in the electrolytic bath 21. For the electrolytic solution 26, it is possible to use a hydrochloric acidic solution of tin chloride obtained by leaching the primary refined electrodeposited tin resulting from the electrolytic refining in the step (1) with hydrochloric acid.

The raw material tin for use in the anode 23 can be preferably a material obtained by washing the electrodeposited tin resulting from the electrolytic refining in the step (1) and then melting and casting it in the atmosphere or a vacuum. For the cathode 25, a metal plate made of tin, aluminum, stainless steel, titanium or the like, or a graphite plate can be used.

It is preferable that at least a part of the electrolytic solution has been withdrawn from the electrolytic bath and subjected to solid-liquid separation, in order to prevent the particles in the tin chloride solution from being incorporated into tin to be electrodeposited. The method of solid-liquid separation that can be preferably used includes filtration by passing through a filter. Preferred conditions of the filter used for filtration include the use of an acid resistant substrate such as polyethylene, polypropylene and fluororesin, a larger effective filtration area, ease of replacement due to a cartridge type, higher collection efficiency of fine particles (for example, a microfiltration membrane (MF membrane) having a pore size of 0.05 to 10 μm), lower flow resistance, and the like. Further, when using the hydrochloric acidic solution of tin chloride obtained by leaching the primary refined electrodeposited tin resulting from the electrolytic refining in the step (1) with hydrochloric acid, or when casting the primary refined tin at a temperature of 300° C. or higher and removing the smoothing agent components (organic substances) as oxides, a part of them may be incorporated into the cast product, and the remaining components of the smoothing agent that may be carried from the step (1) cannot be removed only by the solid-liquid separation. Therefore, it is preferable to further remove the remaining components (mainly carbon and oxygen). The method of removing the remaining components of the smoothing agent includes, but not limited to, a method of passing through an activated carbon filter. The method of removing the remaining components also includes a method of removing the remaining components by introducing to the electrolytic bath high purity activated carbon powder from which metal components has been previously removed by extraction with an acid such as hydrochloric acid and sulfuric acid, agitating it for a certain period of time, and then carrying out the solid-liquid separation to remove the remaining components of the smoothing agent. Alternatively, microfiltration and the like would be effective. The solid-liquid separation process and the smoothing agent removal process may be performed in separate processes or in the same process.

For the electrolytic refining in the hydrochloric acid bath, it is preferable not to add the smoothing agent in order to avoid contamination of the particles due to involvement of the smoothing agent in the electrodeposited metal. As a result, the electrodeposited tin metal in the hydrochloric acid bath is in the form of needle.

Excessive high concentration of tin in the electrolytic solution will lead to an increase in the specific gravity and an increase in the load of the liquid supply pump for circulating the electrolytic solution, thereby wastefully consuming energy. Also, it will lead to an increase in extra mechanisms. On the other hand, excessive low concentration of tin in the electrolytic solution will increase the resistance of the electrolytic solution and lead to increased generation of hydrogen that will compete with the tin electrodeposition, so that the deposition of tin will be prevented. Therefore, the concentration of tin in the electrolytic solution is preferably about 10 to 150 g/L, and more preferably 30 to 100 g/L.

An excessive high pH of the electrolytic solution will result in deposition of the tin ions as hydroxides by hydrolysis, thereby leading to a decrease in the tin concentration. On the other hand, an excessive low pH will lead to increased generation of hydrogen from the anode plate, thereby inhibiting the deposition of tin. Therefore, the pH is preferably from 0.0 to 1.0, and more preferably from 0.01 to 0.8.

An excessive high liquid temperature during the electrolytic refining will lead to an increase in the mechanical load on the facility, whereas an excessive low liquid temperature will lead to wasteful consumption of energy. Therefore, the liquid temperature during the electrolytic refining is preferably 10 to 40° C.

The current density of the cathode during the electrolytic refining may be preferably 1 to 10 $A/dm^2$, and more preferably 2 to 8 $A/dm^2$. Excessive low current density will lead to a decrease in productivity and excessive high current density will lead to an increase in the electrolysis voltage, so that generation of hydrogen will be increased and the current efficiency will be decreased, thereby resulting in the waste of power.

After the electrolytic refining with the hydrochloric acid bath, needle-like electrodeposited tin deposited on the surface of the cathode is pulled up and recovered from the electrolytic bath, the recovered needle-like electrodeposited tin is sufficiently washed with pure water and then dried. If the drying temperature is too low, more time will be required for drying, whereas if the drying temperature is too high, excessive oxidation of tin may occur due to heat. Therefore, the drying temperature is preferably 60 to 100° C., and more preferably 80 to 100° C.

(Step (3))

In an embodiment, the method for producing the high purity tin according to the present invention comprises melting and casting the needle-like secondary refined electrodeposited tin obtained in the step (2) under a reducing gas atmosphere. The dried needle-like electrodeposited tin is melted and cast in a reducing gas atmosphere such as hydrogen or carbon monoxide at a temperature of 500 to 1,000° C. to produce the high purity tin. The needle-like electrodeposited tin has a very large surface, so that many portions of the electrodeposited tin may be oxidized when heated in the atmosphere. The melting and casting in the reducing atmosphere such as hydrogen and the like removes oxygen that will cause the particles, so that the particle size and the number of the resulting high purity tin are decreased. Further, such a step can prevent oxidation of the needle-like electrodeposited tin and avoid a decrease in the yield, so that production costs can be reduced and the productivity of the high purity tin can be improved.

(High Purity Tin)

The purity of the high purity tin (refined electrodeposited tin) obtained by the method for producing the high purity tin according to one embodiment of the present invention is evaluated by glow discharge mass spectrometry (GDMS). Further, the oxygen concentration is evaluated by a non-dispersive infrared absorption method. It should be noted that the representation of the unit "ppm" as used herein means "mass ppm" (ppm by mass).

In an embodiment, the purity of the high purity tin according to the present invention may be 5N or more, and typically 6N or more, and more typically 7N or more. When tin is considered to be a matrix, the impurity elements contained in the high purity tin are expressed by symbols of elements: Li, Be, B, F, Na, Mg, Al, Si, P, S, CI, K, Ca, Sc, Ti, V, Cr, Mn, Fe, Co, Ni, Cu, Zn, Ga, Ge, As, Se, Br, Rb, Sr, Y, Zr, Nb, Mo, Ru, Rh, Pd, Ag, Cd, In, Sb, Te, I, Cs, Ba, La, Ce, Pr, Nd, Sm, Eu, Gd, Tb, Dy, Ho, Er, Tm, Yb, Lu, Hf, Ta, W, Re, Os, Ir, Pt, Au, Hg, Tl, Pb, Bi, Th and U, and measurement of the impurity elements means analysis of those elements by the GDMS method. It should be noted that the raw material tin and Comparative Example 1 show measurement results of the total 73 element components by the GDMS method.

In an embodiment, as a result of mass spectrometric analysis by the GDMS method, the high purity tin according to the present invention may have the concentration of iron of 0.5 ppm or less, and preferably 0.05 ppm or less, and more preferably less than 0.005 ppm.

In an embodiment, as a result of mass spectrometric analysis by the GDMS method, the high purity tin according to the present invention may have the concentration of copper of 0.5 ppm or less, and preferably 0.05 ppm or less, and more preferably less than 0.005 ppm.

In an embodiment, as a result of mass spectrometric analysis by the GDMS method, the high purity tin according to the present invention may have the concentration of antimony of 1.0 ppm or less, and preferably less than 0.5 ppm.

In an embodiment, as a result of mass spectrometric analysis by the GDMS method, the high purity tin according to the present invention may have the concentration of lead of 0.5 mass ppm or less, and preferably 0.1 ppm or less, and more preferably less than 0.01 ppm.

In an embodiment, as a result of mass spectrometric analysis by the GDMS method, the high purity tin according to the present invention may have the concentration of sulfur of 0.5 ppm or less, and preferably 0.1 ppm or less, and more preferably less than 0.01 ppm.

In one embodiment, as a result of mass spectrometric analysis by the non-dispersive infrared absorption method, the high purity tin according to the present invention may have the concentration of oxygen of 10 ppm or less, and preferably less than 5 ppm.

In an embodiment, as a result of mass spectrometric analysis by the GDMS method, the high purity tin according to the present invention may show that all of Li, Be, B, F, Na, Mg, Al, Si, P, S, CI, K, Ca, Sc, Ti, V, Cr, Mn, Fe, Co, Ni, Cu, Zn, Ga, Ge, As, Se, Br, Rb, Sr, Y, Zr, Nb, Mo, Ru, Rh, Pd, Ag, Cd, In, Sb, Te, I, Cs, Ba, La, Ce, Pr, Nd, Sm, Eu, Gd, Tb, Dy, Ho, Er, Tm, Yb, Lu, Hf, Ta, W, Re, Os, Ir, Pt, Au, Hg, Tl, Pb, Bi, Th and U are less than a detection limit.

In the present invention, the expression "less than a detection limit" means that Sc and V are less than 0.001 ppm; Li, Be, B, Ti, Cr, Mn, Fe, Cu, Ga, As, Rb, Sr, Y, Zr, Nb, Rh, Pd, Ag, Ce, Nd, Sm, Gd, Tb, Dy, Ho, Er, Tm, Yb, Lu, Bi, Th and U are less than 0.005 ppm; Na, Mg, Al, Si, P, S, CI, K, Ca, Co, Ni, Zn, Ge, Se, Mo, Ru, Eu, Hf, W, Re, Os, Ir, Pt and Pb are less than 0.01 ppm; TI is less than 0.02 ppm; F, Br, Cd, I, Cs, Au and Hg are less than 0.05 ppm; Te, Ba, La and Pr are less than 0.1 ppm; Sb is less than 0.5 ppm; In is less than 1 ppm; and Ta is less than 5 ppm.

In one embodiment of the high purity tin according to the present invention, the number of particles each having a particle size of 0.5 μm or more may be 50,000 or less per a gram of tin, and preferably 40,000 or less, and more preferably 30,000 or less, and even more preferably 10,000 or less, for example, from less than 5,000 to 50,000.

In the present invention, the number of the particles is defined as the same meaning as insoluble residue particle number (LPC). The insoluble residue particle number (LPC) is a parameter that is important as one of methods for evaluating metal materials for electronic devices and means the insoluble residue particle number detected when the metal is subjected to acid dissolution. Very good correlation is found between the LPC values and qualities of electronic materials, especially failure rates of sputter deposition including generation of particles when sputtering is carried out by using a sputtering target.

It should be noted that the abbreviation "LPC" is used for the insoluble residue particle number because Liquid Particle Counter is employed for measuring the LPC.

The method for measuring the insoluble residue particle number (LPC) will be specifically described. 5 g of a sample is collected in a clean room with class 100 (US 209E standard), and 200 mL of hydrochloric acid with concentration of 6N is added to the sample over 1 hour, and then heated to 140° C. and held for 48 hours to completely dissolve the sample. The resulting solution is allowed to cool for 1 hour, and further diluted with pure water to be 500 mL. 10 mL of the solution is corrected, and particles in the solution are measured with a particle counter according to JIS B9925: 2010. For example, if the number of particles is 1000 per mL, it means that 0.1 g of the sample is measured per 10 mL, and the number of particles are then 100,000 per 1 g.

EXAMPLE

Hereinafter, although Examples and Comparative Examples will be illustrated, these are provided for better understanding of the present invention, and the present invention is not intended to be limited to the Examples and Comparative Examples.

Example 1

(Step (1))

The electrolytic refining apparatus having the configuration as shown in FIG. 1 was used. The apparatus had the electrolytic bath partitioned by disposing an anion exchange membrane (SELEMION® AMV available from Asahi Glass Co., Ltd.) between an anode and an cathode, and a dilute sulfuric acid solution with a pH of 0.6 was placed on the anode side, and a sulfuric acid solution in a required amount to react with tin dissolved in the anode was placed the cathode side. An anode cast from the raw material tin and a titanium cathode were arranged in the electrolytic bath, and electrolytic leaching was then carried out in a cathode current density of 2 A/dm$^2$ and at a liquid temperature of 30° C. to form an electrolytic solution of tin sulfate (a tin concentration of 98 g/L).

Here, results of analysis of the raw material tin (raw material) are shown in FIG. 3-1 and FIG. 3-2. Oxygen was analyzed by the non-dispersive infrared absorption method, and the other elements were measured for quality by the GDMS method. It should be noted that for the electrolytic refining, 5 g/L of hydroquinone was added as an antioxidant on the anode side.

After the electrolytic leaching, the whole amounts of both the anode chamber electrolytic solution and the cathode chamber electrolytic solution were withdrawn. The anode chamber electrolytic solution was placed in the liquid cleaning tank for removing lead, and in the tank, 5 g/L of strontium carbonate was then added to the electrolytic solution and stirred for 16 hours. The stirred electrolytic solution was subjected to solid-liquid separation by filter press (a filtration pressure of 0.4 MPa; a squeezing pressure of 0.7 MPa; filter cloth material made of polypropylene filter cloth; a degree of air permeability of 100 cm$^3$/cm$^2$/min) to remove oxide sludge and solid impurities together with lead in the electrolytic solution. The electrolytic solution after removal was charged on the cathode side. The lead concentration after removal of lead was less than 0.1 mg/L as determined by ICP emission spectrometry.

Further, to the electrolytic solution on the cathode side was added 5 g/L of polyoxyethylene (10) nonyl phenyl ether. Furthermore, to the anode side was newly added a dilute sulfuric acid solution having a pH of 0.6. In this state, electrolytic deposition was carried out at a cathode current density of 2 A/dm$^2$, a pH of 0.6 and a liquid temperature of 30° C. until the tin concentration in the electrolytic solution on the cathode side was reached from 98 g/L to 40 g/L, and the cathode was then pulled out from the electrolytic bath. The electrodeposited tin deposited on the cathode was peeled off, washed with pure water, and dried to obtain primary refined electrodeposited tin.

(Step (2))

The primary refined electrodeposited tin obtained in Step (1) was melted and cast by heating it in the atmosphere at a temperature of 250 to 300° C. to obtain cast tin. A part of the cast tin was leached in hydrochloric acid with concentration of 6 N to obtain a tin chloride solution having a concentration of 60 g/L and a pH of 0.2. In the tin chloride solution, electrolytic refining was carried out at a current density of 4 A/dm$^2$, a pH of 0.2 and a liquid temperature of 25° C., using the electrolytic refining apparatus having configuration as shown in FIG. 2, which was different from that in the step (1) and in which a part of the cast tin as an anode and a cathode made of titanium were placed in the electrolytic bath, respectively. During electrolysis, a part of the electrolytic solution (100 L) was withdrawn in a circulating flow rate of 1 to 10 L/min, and subjected to two-stage filtering with an activated carbon filter ADVANTEC TCC-A1-S0CO and ADVANTEC TCPD-01A-SIFE (1 μm particle correction efficiency of 99.9%) installed in the front stage and back stage, respectively, and then circulated to the electrolytic bath. Electrolysis was carried out for a certain period of time while continuing circulation of the electrolytic solution, and the cathode was then pulled up from the electrolytic bath. The electrodeposited tin deposited on the cathode was peeled off, sufficiently washed with pure water until the washing water showed neutrality, and dried in a dryer at 95° C. for 16 hours. Needle-like secondary refined electrodeposited tin was thus obtained.

(Step (3))

1,000 g of the electrodeposited tin resulting from the two-stage refining was subjected to heating and melting (thermal hydrogen treatment) in a reduction furnace at a hydrogen flow rate of 1 L/min and a temperature 800° C. for 4 hours and then cast to obtain high purity tin.

(Evaluation)

Using a part of the resulting high purity tin, impurities were measured by the GDMS method. Results of measurement are shown in FIG. 3-1 and FIG. 3-2. The impurities were less than a minimum limit of quantification for all elements, as shown in FIG. 3-1 and FIG. 3-2. Similarly, using a part of the resulting high purity tin, oxygen content was measured by the non-dispersive infrared absorption method, and found that it was less than 5 ppm, a minimum limit of quantification.

Using a par of the resulting high purity tin, the insoluble residue particle number was measured by the above mentioned method with a light scattering automatic particle counter for liquid (KS-42B from Kyushu RION corporation). As a result, the number of particles each having a particle size of 0.5 μm or more, which were present in 1 g of tin, was 5,170. For the refined tin, impurities were sufficiently decreased and the number particles was also very small.

Examples 2 and 3

High purity tin of each of Examples 2 and 3 was obtained using the same steps as those of Example 1, with the exception that conditions were changed as described in Table 1 below.

TABLE 1

| Factor | Example 1 | Example 2 | Example 3 |
|---|---|---|---|
| Electrolysis Current density of Sulfuric Acid Bath (During Electrolytic Deposition) | 2 A/dm$^2$ | 1.5 A/dm$^2$ | 2.2 A/dm$^2$ |
| Electrolysis pH of Sulfuric acid bath (During Electrolytic deposition) | pH 0.6 | pH 0.6 | pH 0.8 |

TABLE 1-continued

| Factor | Example 1 | Example 2 | Example 3 |
|---|---|---|---|
| Electrolysis in Sulfuric Acid Bath Concentration of Tin in Electrolytic solution on Cathode side | 98 → 40 g/L | 96 → 36 g/L | 95 → 32 g/L |
| Electrolysis Current Density of Hydrochloric Acid Bath | 4 A/dm$^2$ | 4 A/dm$^2$ | 3.5 A/dm$^2$ |
| Electrolysis pH of Hydrochloric Acid Bath | pH 0.2 | pH 0.2 | pH 0.1 |
| Concentration of Tin in Electrolytic Hydrochloric Acid Bath | 60 g/L | 63 g/L | 64 g/L |
| Thermal Hydrogen Treatment Temperature | 800° C. | 600° C. | 600° C. |

Using a part of the resulting high purity tin, impurities were measured by the GDMS method. Results of measurement are shown in FIG. 3-1 and FIG. 3-2. In both Examples 2 and 3, the impurities were less than a minimum limit of quantification for all elements, as shown in FIG. 3-1 and FIG. 3-2. Similarly, using a part of the resulting high purity tin, oxygen content was measured by the non-dispersive infrared absorption method, and found that it was less than 5 ppm, a minimum limit of quantification, for both Examples 2 and 3.

Using a part to the resulting high purity tin, the insoluble residue particle number was measured by the above mentioned method. As a result, the numbers of particles having a particle size of 0.5 μm or more, which were present in 1 g of tin, were 9,060 for Example 2 and 13,800 for Example 3. In both Examples 2 and 3, the refined tin had sufficiently decreased impurities and the number of particles was also very low.

Comparative Example 1

The primary purification tin resulting from electrolysis in the sulfuric acid bath in Example 1 was evaluated in the same manner as that of the high purity tin of Example 1 without conducting the secondary refining. Results are shown in FIG. 3-1 and FIG. 3-2. Minor amounts of iron, copper and silver were detected as impurities, and oxygen was also detected. Particles were significantly increased as compared with Examples 1-3.

Comparative Example 2

The secondary refined tin resulting from electrolysis in the hydrochloric acid bath in Example 1 was cast in the atmosphere rather than the reducing atmosphere. The great part of the secondary refined tin was oxidized and a very small amount of metal tin was only obtained. The metallic tin separated and collected from oxides was evaluated in the same manner as that of the high purity tin of Example 1. Results are shown in FIG. 3-1 and FIG. 3-2. Miner amounts of phosphorus and chlorine were detected as impurities, and a large amount of oxygen was also detected. Particles were significantly increased as compared with Examples 1-3.

DESCRIPTION OF SYMBOLS

1 electrolytic bath
2 liquid cleaning bath
3 filtering device
5 storage tank
**4*a*-4*d*** liquid supply lines
11 cathode
12 anode
13 cathode chamber
14 diaphragm
15 anode chamber
21 electrolytic bath
22 filter
23 anode
**24*a*-24*b*** liquid supply lines
25 cathode
26 electrolytic solution

What is claimed is:

1. High purity tin product having a purity of 5N (99.999% by mass) or more, the high purity tin product containing high purity tin and insoluble residue particles wherein the number of insoluble residue particles each having a particle diameter of 0.5 μm or more is greater than 0 and up to 50,000 per gram, and wherein the number of insoluble residue particles are determined by placing a 5 g sample of the high purity tin product in 200 mL hydrochloric acid having a 6N concentration for one hour, heating the sample to 140° C. for 48 hours to dissolve the sample, cooling the sample, diluting the sample with 500 mL pure water and then measuring a number of particles in a portion of the sample using a particle counter according to JIS B9925: 2010.

2. The high purity tin product according to claim 1, wherein the number of insoluble residue particles each having a particle diameter of 0.5 μm or more is greater than 0 and up to 10,000 per gram.

3. The high purity tin product according to claim 1, wherein each of concentrations of iron, copper, lead and sulfur contained in the high purity tin is 0.5 ppm by mass or less.

4. The high purity tin product according to claim 1, wherein a concentration of antimony is 1 ppm by mass or less.

5. The high purity tin product according to claim 1, wherein a concentration of oxygen is less than 5 ppm by mass.

6. A method for producing high purity tin product according to claim 1, comprising:

a step (1) of providing primary refined electrodeposited tin on a surface of a cathode by carrying out electrolytic refining in an electrolytic bath partitioned into an anode chamber and a cathode chamber by disposing a diaphragm between an anode and a cathode, said electrolytic bath containing a sulfuric acidic solution of tin sulfate as an electrolytic solution and raw material tin as said anode, said raw material tin having a lead content of 20 ppm by mass or less, an iron content of 5 ppm by mass or less, a copper content of 0.5 ppm by mass or less, an antimony content of 5 ppm by mass or less and the total content of silver, arsenic, bismuth, cadmium, copper, iron, indium, nickel, lead, antimony and zinc of 30 ppm by mass or less, while adding to at least said cathode chamber a smoothing agent for reducing a surface area of electrodeposited tin, wherein said step (1) comprises withdrawing at least a part of said tin sulfate solution on said anode chamber side, removing lead and an oxide sludge in said withdrawn tin sulfate solution, and supplying said tin sulfate solution resulting from the removal of lead and the oxide sludge to said cathode chamber;

a step (2) of providing needle shaped secondary refined electrodeposited tin on a surface of said cathode by carrying out electrolytic refining in an electrolytic bath containing said primary refined electrodeposited tin or cast tin resulting from heating, melting and casting of said primary refined electrodeposited tin as an anode and a hydrochloric acidic solution of tin chloride as an electrolytic solution, wherein said step (2) comprises withdrawing at least a part of said tin chloride solution from said electrolytic bath, removing particles which can be removed by filtration in said tin chloride solution and remaining components of said smoothing agent carried from the step (1), and then recycling to said electrolytic bath again said tin chloride solution from which said particles and said remaining components of said smoothing agent have been removed; and a step (3) comprising melting and casting said needle shaped secondary refined electrodeposited tin in a reducing gas atmosphere.

7. The method for producing high purity tin product according to claim 6, wherein said smoothing agent comprises a nonionic surfactant composed of a compound having a structure in which one or more hydroxyl groups are bonded to an aryl group(s) directly or via one or more methylene groups and/or one or more ethylene oxide groups.

8. The method for producing high purity tin product according to claim 6, wherein said smoothing agent comprises polyoxyethylene alkyl phenyl ether.

9. The method for producing high purity tin product according to claim 6, wherein said step (1) further comprises adding an antioxidant to said tin sulfate solution together with said smoothing agent.

* * * * *